United States Patent [19]

Wolowski et al.

[11] Patent Number: 4,597,851

[45] Date of Patent: Jul. 1, 1986

[54] PROCESS FOR THE UTILIZATION OF WASTE WATERS IN THE HYDROGENATION OF COAL

[75] Inventors: Eckard Wolowski, Mülheim; Hans-Friedrich Tamm, Recklinghausen, both of Fed. Rep. of Germany

[73] Assignee: Ruhrkohle Aktiengesellschaft, Essen, Fed. Rep. of Germany

[21] Appl. No.: 624,105

[22] Filed: Jun. 25, 1984

[30] Foreign Application Priority Data

Jun. 24, 1983 [DE] Fed. Rep. of Germany ..... 3322784

[51] Int. Cl.[4] ..... C10G 1/06; C10G 1/00

[52] U.S. Cl. ..... 208/400; 208/424; 203/96; 210/749

[58] Field of Search ..... 208/10, 8 LE

[56] References Cited

U.S. PATENT DOCUMENTS

| | | | |
|---|---|---|---|
| 1,931,550 | 10/1933 | Krauch et al. | 208/10 |
| 1,983,234 | 12/1934 | Krauch et al. | 208/10 |
| 1,990,708 | 2/1935 | Pier et al. | 208/10 |
| 1,994,075 | 3/1935 | Krauch et al. | 208/10 |
| 1,996,009 | 3/1935 | Krauch et al. | 208/10 |
| 3,503,866 | 3/1970 | Skripek et al. | 208/10 |
| 3,909,390 | 9/1975 | Urban | 208/10 |
| 3,926,775 | 12/1975 | Schroeder | 208/10 |
| 3,944,480 | 3/1976 | Schroeder | 208/10 |
| 3,954,596 | 5/1976 | Schroeder | 208/10 |
| 4,260,471 | 4/1981 | Miller | 208/10 |
| 4,350,582 | 9/1982 | Rosenthal et al. | 208/8 LE |

*Primary Examiner*—William G. Wright

*Attorney, Agent, or Firm*—Nils H. Ljungman

[57] ABSTRACT

The invention provides a process for the utilization of waste water in a coal hydrogenation plant. The demand for processed water and the amount of water required in the hydrogenation of coal is reduced by the use of the resulting waste water from an atmospheric distiller and/or a vacuum distiller as quenching water in a cold precipitator stage of the coal hydrogenation process.

5 Claims, 1 Drawing Figure

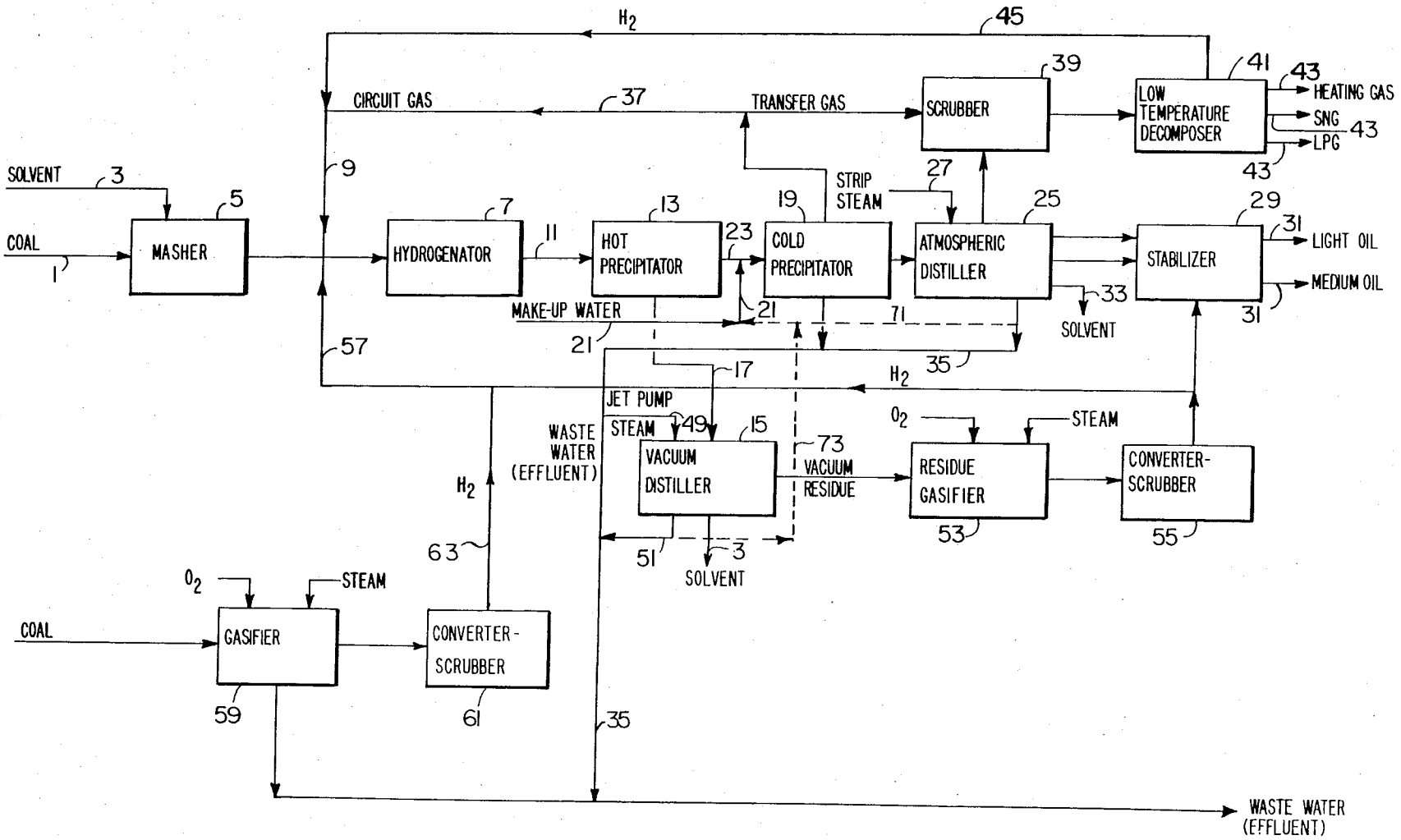
HEATING GAS
SNG
LPG
LIGHT OIL
MEDIUM OIL
WASTE WATER (EFFLUENT)
LOW TEMPERATURE DECOMPOSER
STABILIZER
CONVERTER-SCRUBBER
SCRUBBER
ATMOSPHERIC DISTILLER
RESIDUE GASIFIER
COLD PRECIPITATOR
HOT PRECIPITATOR
VACUUM DISTILLER
HYDROGENATOR
MASHER
GASIFIER
CONVERTER-SCRUBBER
SOLVENT
STEAM
STRIP STEAM
TRANSFER GAS
CIRCUIT GAS
MAKE-UP WATER
JET PUMP
VACUUM RESIDUE
WASTE WATER (EFFLUENT)
COAL
SOLVENT
COAL
$H_2$
$O_2$
STEAM
$O_2$
$H_2$
$H_2$

PROCESS FOR THE UTILIZATION OF WASTE WATERS IN THE HYDROGENATION OF COAL

BACKGROUND OF THE INVENTION

1. Field of the Invention

The invention relates to an improved process for the hydrogenation of coal. More particularly, the invention provides a technique for the utilization of waste water generated during conventional coal hydrogenation processes.

2. Description of Prior Art

Coal hydrogenation is normally understood to mean the addition of hydrogen to coal under pressure and under cracking conditions in the course of which catalysts are employed. During the hydrogenation process, oxygen contained in the coal is partly converted into tar acids, that is, into phenols, cresols and xylenols. A further portion of the oxygen leads to the formation of reaction water during the hydrogenation process. Following the hydrogenation reactor, there are precipitators in which the hydrogenated products are separated. The separation of a coal-oil phase and aqueous phase is effected in the so-called cold precipitators.

Quenching water is injected into the cold precipitator in order to prevent blockages due to salt deposition in the pipe lines of the hydrogenation plant subsequent to the cold precipitators. This quenching water, together with reaction water, forms an aqueous phase in the cold precipitator. Tar acids present in the coal are highly water soluble products. As a result, tar acids become a significant constituent of the reaction water and quenching water products.

Additionally, further quantities of tar acid containing waste waters are formed during the atmospheric distillation of the coal oil obtained in the hydrogenation operation, which is carried out with the addition of hydrogen. Tar acid containing waste water is also found in the condensate of hydrogenation residue from the vacuum distiller's steam input.

Because of the high tar acid content, as well as the hydrogen sulfide and ammonium which waste waters from a hydrogenation plant contain, these waste waters cannot be discharged into the open waters for obvious environmental considerations. It is the conventional practice to feed these contaminated waste waters to a phenol extracting plant and a subsequent following waste water treatment system after having separated out the hydrogen sulfide and ammonium. The waste water, thus treated, is generally suitable for discharge. This conventional treatment requires a considerable expenditure in both equipment and energy which becomes economically undesirable the greater the amount of waste water to be treated.

One such proposal to resolve the aforementioned waste water problem can be found in German Patent Publication No. 30 36 259 A 1 which seeks to employ the tar acid containing waters in a gasification plant, which is connected with a hydrogenation plant. This plant serves to produce hydrogen from a vacuum residue or coal. The process is such that the vacuum residue or the coal is introduced as a water suspension into a reactor. The suspension consists of water which contains tar acids. This possible solution to the aforedescribed waste treatment process does not require the interposition of purification stages for the waters. However, where no such gasification is available, the use of the aforedescribed waste treatment process is still required.

OBJECTS OF THE INVENTION

It is, therefore, an object of the present invention to simplify the treatment of process waters and the waste waters from a coal hydrogenation plant. This objective is accomplished by employing the tar acid containing waste waters from atmospheric distillation and/or vacuum distillation as quenching water. This greatly reduces the required amount of demineralized water to be supplied to the process. Additionally, the resulting total amount of water to the hydrogenation plant is reduced by the amount returned through the recycling of previously used quenching water.

It is also an object of this invention to increase the amount of coal-oil produced by reducing the amount of tar acid going over into the aqueous phase as a consequence of the tar acid concentration already contained in the waste water product which is recycled to the coal precipitator as quenching water.

SUMMARY OF THE INVENTION

In a coal hydrogenation process which includes the steps of hydrogenating coal in a reactor, separating the reaction product from said reactor in a hot precipitator into a first phase consisting of gases and vapors and a second phase consisting of liquids and solids, introducing said first phase into a cold precipitator in which quenching water is introduced to prevent blockages caused by the crystallization of ammonium salts in said precipitator and said second phase into a vacuum distiller, and distilling the product of said cold precipitator in an atmospheric distiller into which stripping steam is introduced and from which atmospheric distiller a waste water phase is produced, said waste water phase containing tar acids, the improvement wherein at least a portion of said waste water phase is injected into said cold precipitator as quenching water.

This improved coal hydrogenation process in which the liquid and solid phase of the hot precipitator are introduced into the vacuum distiller which renders a condensate product containing tar acid includes the further improvement wherein at least a portion of said condensate product is additionally injected into the cold precipitator as quenching water.

Thus, this invention provides an improvement to a coal hydrogenation process which includes the step of injecting quenching water into a cold precipitator for preventing salts deposits in the cold precipitator and from which hydrogenation process tar acid containing waste water is generated. The improvement comprises the step of returning at least a portion of the tar acid containing waste water for use as quenching water in the cold precipitator. This recycled waste water can be the product of an atmospheric distiller and/or vacuum distiller.

BRIEF DESCRIPTION OF THE DRAWING

The above, as well as other features and advantages of the present invention, will become apparent through consideration of the detailed description of the invention in conjunction with the sole figure which is a schematic illustration of a coal hydrogenation plant in the form of a flow diagram in which the improvement, according to the teaching of this invention, is shown in broken line.

DESCRIPTION OF THE PREFERRED EMBODIMENTS

The hydrogenation process begins with the admixture of coal 1 with solvent 3 in a masher 5. The dried coal is converted with solvent into a mash in a masher 5 and then conveyed into a reactor 7 with the addition of hydrogen via line 9. The reaction products are conveyed from the hydrogenation reactor 7 via line 11 into hot precipitator 13. In the hot precipitator 13, a first phase consisting of gases and vapors is drawn off from the top and a second phase consisting of liquids and solids is taken from the sump and fed into a vacuum distiller 15 via line 17.

After cooling, the head produced from the hot precipitator 13 is fed to a following cold precipitator 19. Here, in the cold precipitator 19 together with the coal oil, water is accumulated as a liquid phase. A portion of this water is formed from the oxygen chemically bound in the coal and a further portion of this water consists of the injection water or quenching water which is introduced into the cold precipitator 19 via line 21 and 23. The quenching water from line 21 is sprayed into the vapor phase as it is conveyed from the hot precipitator 13 via line 23 into the cold precipitator 19 in order to prevent blockages caused by the crystallization of ammonium salts in the vapor phase. The water contains part of the tar acids (phenols, cresols, xylenols) which likewise are form in the hydrogenator from the oxygen contained in the coal.

The coal oil obtained in the cold precipitator 19 is atmospherically distilled in an atmospheric distiller 25 with the addition of stripping steam via line 27. The water phase produced during the cooling of the head product also contains tar acids. Light and medium oils from the atmospheric distiller 25 are subjected to a hydrogenating stabilization 29 from which light oil and medium oil products 31 are produced. Additionally, from the atmospheric distiller, solvent is recovered at 33.

The aforedescribed water phase resulting from the atmospheric distiller 25 had heretofore under conventional processes been conveyed to waste water effluent treatment facilities via line 35.

The first gaseous and vaporous phase leaving via the head of the cold precipitator 19 is divided, after an oil wash carried out under process pressure, into feed back circuit and transfer out gas as at line 37. The transfer out gas is purified in a scrubber 39 and then decomposed in a low temperature decomposition plant 41 into hydrogen, heating gas, SNG and LPG as at 43. The hydrogen can be conveyed via line 45 back to the hdyrogenator 7 for combination with the solvent and dried coal.

The solids containing residue from the hot precipitator 13 is topped or lightly distilled in the vacuum distiller 15. The heavy oil thus obtained is fed back along with heavy and medium oils from the atmospheric distiller as a solvent via line 3 into the masher 5. Steam jet booster pumps 49 are used to produce a vacuum in the vacuum distiller 15. As a result, a certain amount of tar acid is contained in the condensate of the booster steam employed which condensate is recovered via line 51. Heretofore, it had been the process to convey the contaminated condensate from the vacuum distiller 15 along with the waste water from the atmospheric distiller 25 via line 35 for conventional waste water treatment.

Synthesis gas ($CO+H_2$) is obtained, from the residue from the vacuum distiller 15 via residue gasifier 53 or additional hydrogenating hydrogen is obtained from the converter scrubber 55 and conveyed via line 57 for use in the hydrogenation reactor 7. If the hydrogen which is fed back via line 45 from the low temperature decomposer 41 and the hydrogen fed back via line 57 from the converter scrubber 55 is insufficient for hydrogenation and stabilization, the deficit can be covered via an additional coal gasifier 59 in conjunction with a following converter and gas scrubber or purifier 61 from which hydrogen in line 63 is conveyed back to the hydrogenator 7.

According to the present invention, the tar oil containing waste waters from the atmospheric distiller 25 to the quenching stream of hydrogen following the hot precipitator 13 is shown by the broken line designated by reference character 71. The recovered condensate from the vacuum distiller 15 can also be used for injected quenching water and is conveyed via broken line 73 to the cold precipitator 19. Thus, feed back is effected both from the atmospheric distiller 25 and the vacuum distiller 15. What follows is a numerical example for the resulting reduction in waste water output and the use of fresh quenching water in a hydro genation process which incorporates the feed back systems described above.

EXAMPLE

The following waste water quantities and concentrations were measured in a coal liquefying plant used for hydrogenating a gas-flame coal obtained from the Ruhr district, the plant having a throughput of 152 tons (water-free) of coal/day, corresponding to an hourly load of approximately 6.3 tons/hours:

| | Amount tons/day | Tar acid content grams/liter |
|---|---|---|
| Hydrogenation | 45.7 | 9.7 |
| Atmospheric distillation | 7.8 | 16.5 |
| Vacuum distillation | 22.6 | 1.3 |
| Total waste water | 76.1 | 7.9 |

The water resulting in the hydrogenation is thereby composed of the residual moisture of the coal, the injected water and the water which has formed. The amount of injected water is thereby 34.8 tons/day, that is, the 30.4 tons/day of waste water from the distillers can almost cover this water requirement. Advantageously, the amount of tar acid containing waste water obtained is less by this amount. Instead of 76.1 tons/day, only 45.7 tons/day accumulate.

What has been described is an improvement to a coal hydrogenation process through the recirculation of recovered waste waters from both an atmospheric distiller and/or a vacuum distiller. The technique of this invention both significantly reduces the volume of waste water which must be treated prior to disposal as well as the need for fresh water to effect quenching of the hot precipitator product.

The invention, as described hereinabove in the context of a preferred embodiment, is not to be taken as limited to all of the provided details thereof, since modifications and variations thereof may be made without departing from the spirit and scope of the invention.

What is claimed:

1. In a coal hydrogenation process which includes the steps of:

(a) hydrogenating coal in a reactor (7);

(b) separating the reactor product from said reactor (7) in a hot precipitator (13) into a first phase comprising gas and vapor (23), and a second phase comprising liquids and solids (17);

(c) introducing said liquid and solid phase (17) into a vacuum distiller (15) in which steam jet booster pumps (49) produce a vacuum in said vacuum distiller (15), thereby rendering a heavy oil or solvent (3) and a condensate product (51) from the steam of the steam jet booster pumps (49), which condensate product (51) contains tar acid;

(d) introducing said vapor and gas phase (23) into a cold precipitator (19) into which cold precipitator, quenching water (21) (23) is introduced in order to prevent blockages caused by the crystallization of ammonium salts;

(e) distilling the products of said cold precipitator (19) in an atmospheric distiller (25) into which stripping steam (27) is introduced and from which atmospheric distiller (25) light and medium oils (29), solvent (33) and a waste phase (35) are produced, which waste water phase contains tar acids;

the improvement wherein:

at least a portion of said condensate (51) from the steam of the steam jet booster pumps (49) of said vacuum distiller (15) (produced in step (c) is injected into said cold precipitator (19) as quenching water (73-21-23); and wherein at least a portion of said waste water phase (produced in step (e) is injected into said cold precipitator (19) as quenching water (71-21-23).

2. In an improved coal hydrogenation process which includes the step of injected quenching water into a cold precipitator for the purpose of preventing salt deposits in said cold precipitator and from which hydrogenation process tar acid containing waste water is generated, the improvement wherein at least a portion of said waste water is used as quenching water in said cold precipitator.

3. The process according to claim 2 wherein the hydrogenation process includes distillation by an atmospheric distiller from which is recovered a tar containing waste water product and distillation by a vacuum distiller from which is recovered a tar containing condensate product, the improvement wherein both said recovered waste water products are injected into the cold precipitator as quenching water.

4. The process according to claim 2 wherein the hydrogenation process includes an atmospheric distiller from which is recovered a tar containing waste water product, the improvement wherein at least a portion of said recovered waste water product is injected into the coal precipitator as quenching water.

5. The process according to claim 2 wherein the hydrogenation process includes a vacuum distiller from which is recovered a tar containing condensate product, the improvement wherein at least a portion of said recovered condensate product is injected into the coal precipitator as quenching water.

* * * * *